US009303944B2

(12) United States Patent
Barber

(10) Patent No.: US 9,303,944 B2
(45) **Date of Patent: *Apr. 5, 2016**

(54) CROSSBOW WITH INTEGRATED DECOCKING DEVICE

(71) Applicant: Archery America, L.L.C., Dequincy, LA (US)

(72) Inventor: Tim Barber, Honesdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/305,357

(22) Filed: Jun. 16, 2014

(65) Prior Publication Data

US 2014/0305417 A1 Oct. 16, 2014

Related U.S. Application Data

(63) Continuation-in-part of application No. 13/325,953, filed on Dec. 14, 2011, now Pat. No. 8,752,535.

(60) Provisional application No. 61/422,770, filed on Dec. 14, 2010, provisional application No. 61/440,563, filed on Feb. 8, 2011, provisional application No. 61/494,500, filed on Jun. 8, 2011.

(51) Int. Cl.
*F41B 5/12* (2006.01)

(52) U.S. Cl.
CPC .. *F41B 5/123* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 3,561,419 | A | 2/1971 | Cucuzza, Sr. | |
| 4,261,321 | A | 4/1981 | Nishioka | |
| 5,445,139 | A | 8/1995 | Bybee | |
| 5,749,348 | A | 5/1998 | Oviedo-Reyes | |
| 6,273,078 | B1 | 8/2001 | Schwesinger | |
| 6,499,478 | B1 | 12/2002 | Perez | |
| 6,799,566 | B1 | 10/2004 | Malucelli | |
| 7,017,568 | B1 | 3/2006 | Smith | |
| 7,216,643 | B2 | 5/2007 | Pellerite | |
| 8,752,535 | B2 * | 6/2014 | Barber et al. | 124/25 |

OTHER PUBLICATIONS

Vibracheck—SAFEDRAW Shooting System offered by Archery Exchange (www.archeryexchange.com).

* cited by examiner

*Primary Examiner* — John Ricci
(74) *Attorney, Agent, or Firm* — Barclay Damon, LLP

(57) ABSTRACT

A crossbow having an integrated decocking device, including a resistance system having a fluid containing cylinder having a movable piston and located within the static portion of the stock, a shaft extending from the piston and having a terminal end, the piston being movable between a first position and a second position, and the cylinder including an orifice having a size and extending through the piston to enable fluid to travel from one side of the piston to the other and to control the movement of the piston to a desired rate; and a bowstring coupling system coupled to the resistance system and including a cable having a first portion releasably securable to the bowstring and a second portion of the cable interfacing with a location on the shaft of the resistance system.

7 Claims, 6 Drawing Sheets

CROSSBOW WITH INTEGRATED DECOCKING DEVICE

CROSS-REFERENCE TO RELATED APPLICATIONS

This application is a continuation-in-part of U.S. application Ser. No. 13/325,953 filed Dec. 14, 2011, and entitled DECOCKING DEVICE FOR A CROSSBOW (allowed, will issue as U.S. Pat. No. 8,752,535 on Jun. 17, 2014), which claims priority to U.S. Provisional Application Ser. No. 61/422,770 filed Dec. 14, 2010, and entitled DECOCKING DEVICE FOR A CROSSBOW, U.S. Provisional Application Ser. No. 61/440,563 filed Feb. 8, 2011, and entitled DECOCKING DEVICE FOR A CROSSBOW, and U.S. Provisional Application Ser. No. 61/494,500 filed Jun. 8, 2011, and entitled DECOCKING DEVICE FOR A CROSSBOW, each incorporated by reference herein in its entirety.

FIELD

The present disclosure relates to devices for decocking a cocked crossbow. More particularly, the disclosure relates to a crossbow having an integrally incorporated device for facilitating decocking of the crossbow without dry firing or firing a projectile.

BACKGROUND

The disclosure relates to a crossbow that integrates a device uncocking of the crossbow, also called decocking of a crossbow. More directly, the disclosure relates to uncocking or decocking a ready-to-fire crossbow without dry firing or firing a projectile known in the art as an arrow or sometimes referred to as a bolt, a medieval term for a short arrow.

Crossbows are generally cocked by a manually drawing the bowstring by hand to a loaded position or by using a drawstring or a winch-type cranking mechanism that draws the bowstring that is attached to the bowlimbs of the crossbow into a loaded position where the string is locked by a trigger mechanism. This load also known as potential elastic energy is measured in the art today by draw pounds. Most modern crossbows bear draw weights from 100-200 pounds. Once the release mechanism is actuated by the trigger, the bowstring is released and the potential elastic energy transitions to potential kinetic energy.

Drawing a crossbow string to a cocked position is accomplished in several ways. Most commonly today, crossbows are outfitted with a steel or aluminum stirrup mounted on the front of the crossbow. The stirrup is used to hold the front of the bow down with one foot, while the bowstring is drawn using a drawstring typically comprised of braided nylon or polypropylene rope attached to hooks on each end with a "T" or "D" handle that traverses on the drawstring. By attaching the hooks to the bowstring, then stepping in the stirrup and pulling on the handles in an upward motion, the bowstring of the crossbow is drawn into a loaded cocked position.

Another method of cocking the crossbow is a cranktype mechanism. This mechanism uses a gear reduction manual cranking means as the method to draw the bowstring into the loaded position. Efficient as a cocking device, it is generally not recommended to attempt to uncock or decock the crossbow using this device as it can and may cause serious injury to the operator and potentially damage to the crossbow.

Once the bow is cocked, this stored load of elastic energy can be released transitioning to potential kinetic energy by the actuation of a trigger mechanism releasing the bowstring, which then propels a projectile known as an arrow although sometimes referred to as a bolt, with tremendous thrust and speed, away from the crossbow. This is also the typical manner of uncocking, decocking or unloading a cocked or loaded crossbow, which can result in losing, damaging or destroying the deployed arrow. In some jurisdictions it is illegal to exit a hunting area with a loaded weapon, such as a crossbow, requiring one to discharge the crossbow, propelling the arrow prior to exiting the field, a potentially dangerous and inefficient manner of unloading.

Accordingly, there is a need for a decocking structure that can be incorporated into a crossbow structure and operable to decock the crossbow without dry firing or tiring a projectile.

SUMMARY

The disclosure provides a crossbow having an integrated decocking system.

In one aspect, a crossbow according to the disclosure includes a stock having a static portion and a movable portion, a bow having a bowstring, a bowstring catch, a resistance system, and a bowstring coupling system coupled to the resistance system.

The resistance system includes a fluid containing cylinder having a movable piston and located within the static portion of the stock, and a shaft extending from the piston and having a terminal end. The piston is movable between a first position and a second position, and the cylinder includes an orifice having a size and extending through the piston to enable fluid to travel from one side of the piston to the other and to control the movement of the piston to a desired rate.

The bowstring coupling system includes a cable having a first portion releasably securable to the bowstring and a second portion of the cable interfacing with a location on the shaft of the resistance system.

The crossbow is decocked from a cocked state by releasably securing the cable to the bowstring, applying pressure to the piston by pulling on the shaft to extend the shaft, then actuating the catch to release the bowstring, wherein the released bowstring applies pressure to retract the shaft, which pressure is resisted by the resistance system, with the size of the orifice controlling the retraction of the shaft and thereby controlling travel of the bowstring and decocking of the crossbow.

In another aspect, a crossbow according to the disclosure includes a bow having a bowstring, a bowstring catch, a resistance system operatively associated with the crossbow, and a bowstring coupling system coupled to the resistance system.

The resistance system includes a fluid containing cylinder having a movable piston, the piston being movable between a first position and a second position at a desired rate.

The bowstring coupling system includes a cable having a first portion releasably securable to the bowstring and a second portion of the cable interfacing with the resistance system.

The crossbow is decocked from a cocked state by releasably securing the cable to the bowstring, applying pressure to the piston, then actuating the catch to release the bowstring, wherein the released bowstring applies pressure, which pressure is resisted by the resistance system to control travel of the bowstring and decocking of the crossbow.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, there is shown a crossbow 10 having a decocking system 12 integrated into the crossbow 10. The decocking system 12 is operable to enable decocking of the crossbow 10 without dry firing thereof and without firing of a bolt or arrow.

Figure 1:
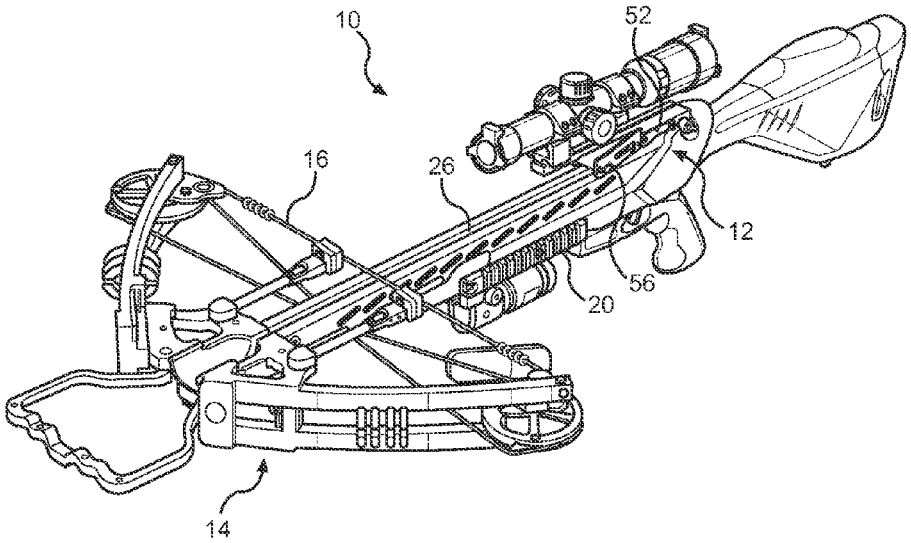
FIGS. 1-3 show a crossbow according to the disclosure having an integrated decocking system.
Figure 2:
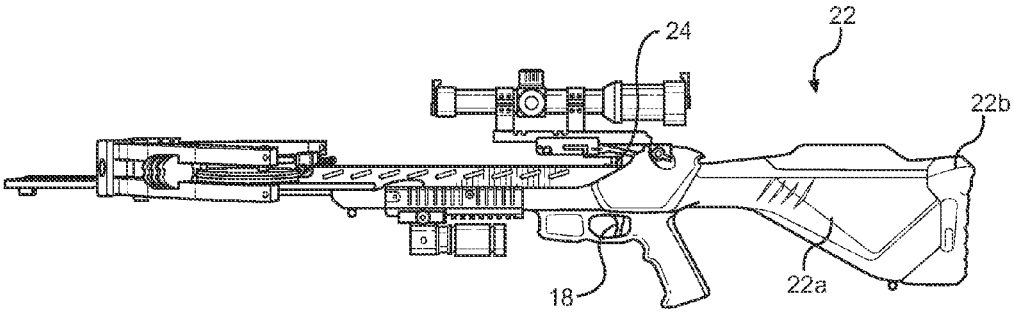
Figure 3:
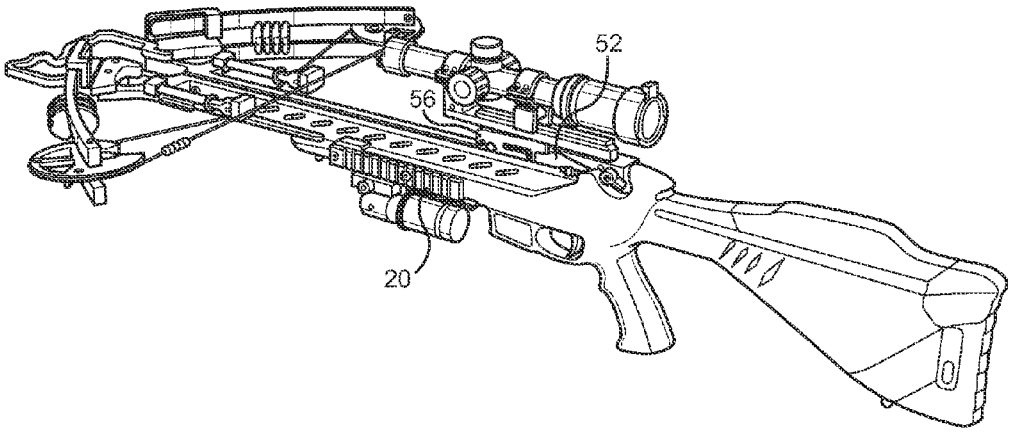

The crossbow 10 is shown in a relaxed state in FIGS. 1-3. FIGS. 4-7 show the crossbow 10 in a tensioned state in which the crossbow is typically loaded with a bolt or arrow, with FIGS. 4-7 showing activation of the decocking system 12 so that the crossbow 10 may be decocked without dry firing thereof and without firing of a bolt or arrow. FIGS. 8-12 shows operation of the decocking system 12 to decock the crossbow 10.

The crossbow 10 includes a bow 14, bowstring 16, trigger 18, a stock including a forestock 20 and a butt stock 22 having a static portion 22*a* and a movable portion 22*b*, a catch 24, and arrow groove 26. An arrow or bolt is oriented in the groove 26 so that a nock of the bolt is maintained in contact with a central portion of the bowstring 16 retained by the catch 24. To fire the crossbow 10, a user activates the trigger 18, which manipulates the catch to release the bowstring and thereby fire the bolt, and decock the crossbow.

The decocking system 12 includes a resistance system 30 and a bowstring coupling system 32. The resistance system 30 supplies a resistance force to enable controlled return of the crossbow from the drawn state to the relaxed state. In this regard, the bowstring coupling system 32 couples the bowstring 16 to the resistance system 30 so as to enable the resistance system 30 to interact with the bowstring 16.

The resistance system 30 may include a double-acting fluid cylinder 40. In this regard, the term "fluid" will be understood to encompass both liquid and gas cylinders. A preferred fluid cylinder is a pneumatic cylinder having an internal piston from which extends in one direction a shaft 42. A through-bored orifice extends through the piston to permit gas/air for other fluid) to travel from one side of the piston to the other side, it being understood that the size of the orifice controls passage of fluid and, hence, travel of the piston and, hence the shaft 42, connected to the piston. A desired dimension of the orifice is 1/16 inches. The cylinder 40 includes an endcap 40*a* at each end of the cylinder 40, with the shaft 42 extending outwardly through one of the endcaps 40*a*. The cylinder also includes a pair of ports located at opposite ends of the cylinder 40 for introduction of fluid (air for a pneumatic cylinder) into the cylinder 40. Double acting pneumatic cylinders utilize air pressure to control movement in both the extending and retracting strokes, i.e., extension of the shaft out of the cylinder and retraction into the cylinder. In this regard, as will be explained more filly below, manual pressure is provided by pulling on the movable portion 22*b* of the butt stock 22 coupled to the end of the shaft 42 to extend the shaft 42 and, when the bowstring 16 is released, the bowstring 16 applies pressure to retract the shaft 42, with the size of the orifice controlling the retraction of the shaft 42 and thereby controlling de-tensioning of the crossbow 10. The cylinder 40 may be otherwise integrated into the crossbow 10 and need not necessarily be located within the butt stock 20.

The coupling system 32 couples the resistance system 30 to the bowstring 16 and includes a pair of pulleys 50 rotatably located on the shaft 42 interior of the movable portion 22*b* of the butt stock 22, a pair of cable cords or decocking cables 52, one trained around each of the pulleys 50. One free end of each of the cables 52 is secured to a spring-loaded cable reel 54, and the other free end of each of the cables 52 is attached to a bow string hook 56 or other connecting structure for releasably connecting the end of the cables 52 to the bowstring 16. Thus, each of the cables 52 is connectable to the bowstring 16. While a single cable could be utilized, it is preferred to utilize at least two for redundancy. Each of the bow string hooks 56 is attached to one side of a cradle 58 that is releasably positionable on the crossbow 10 adjacent the arrow groove 26. The cradle 58 is nominally positioned and maintained out of the way of the arrow groove 26. However, when desired to activate the decocking system 12, the cradle 58 is positioned within the arrow groove 26 so that the hooks 56 engage the bowstring 16. In addition, the cradle 58 is configured to include a rearward surface that simulates the shape of a bolt so as to cooperate with safety features of the bow 10 that serve to disengage the trigger 18 when a bolt is not loaded and prohibit dry firing of the bow 10. The cable reel 24 serves to retract the other ends of the cables 52 to maintain them taught relative to the static portion 22*a* of the butt stock 22. An additional pulley 60 is desirably located within the interior of the static portion 22*a* of the butt stock 22 for separating the cables 52 to avoid tangling, one of the cables 52 being routed over the pulley 60 and the other over the pulley 60. Additional pulleys and the like may be used to reduce friction and the like for routing the cables 52 in and out and within the butt stock 22.

Figure 4:
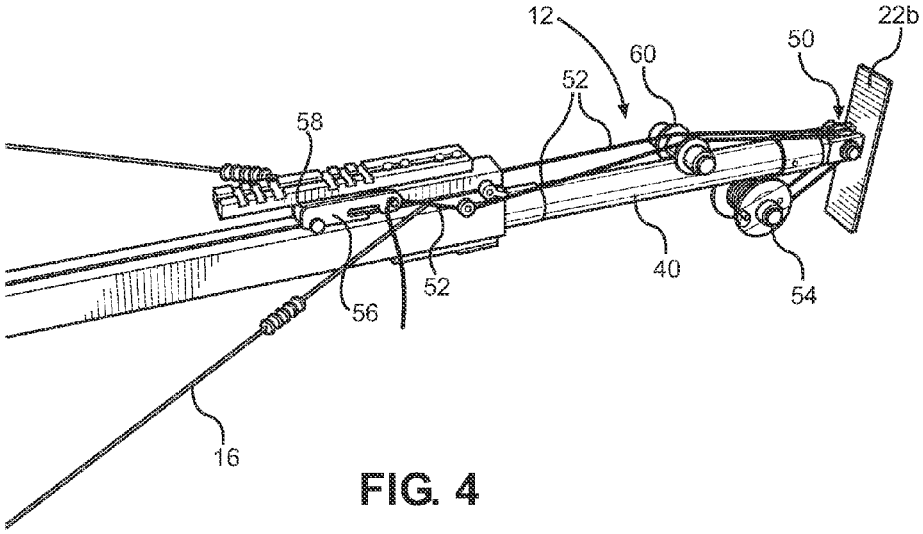
FIGS. 4-7 depict activation of the decocking system so that the crossbow may be decocked.
Figure 5:
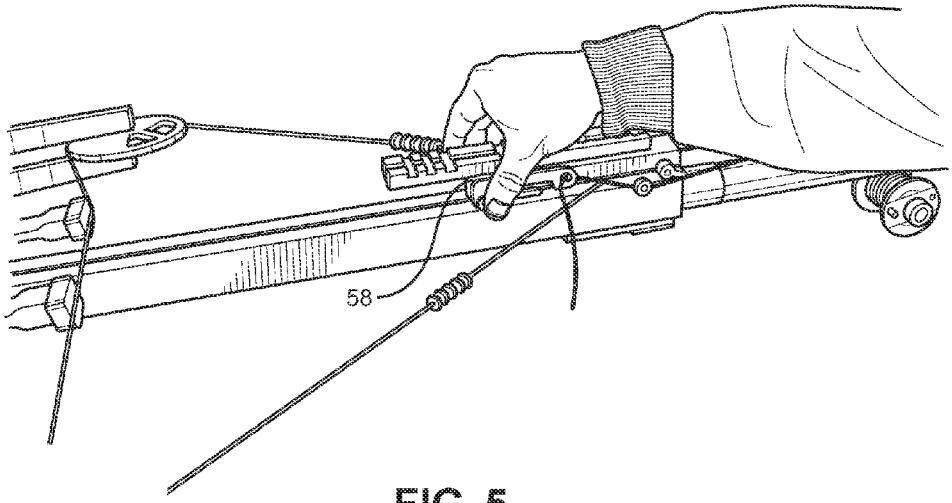
Figure 6:
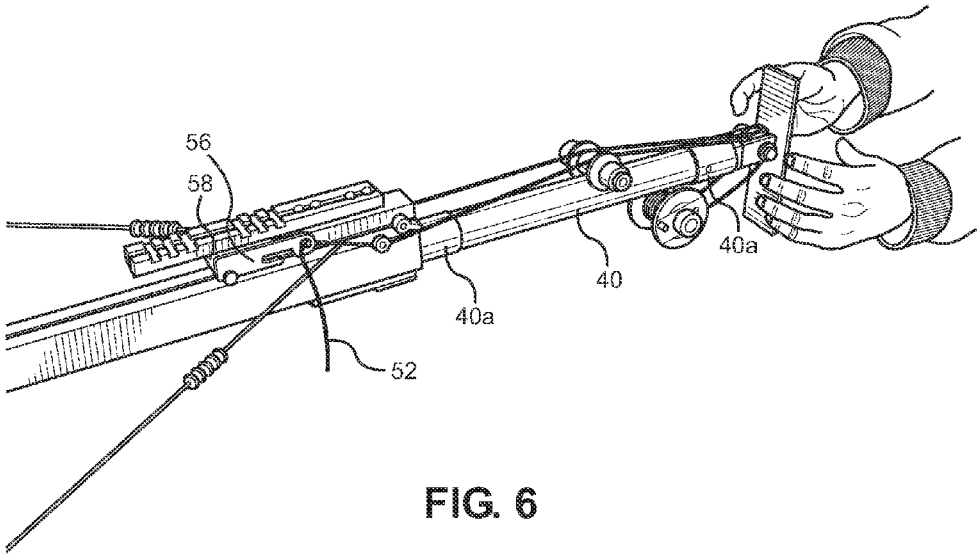
Figure 7:
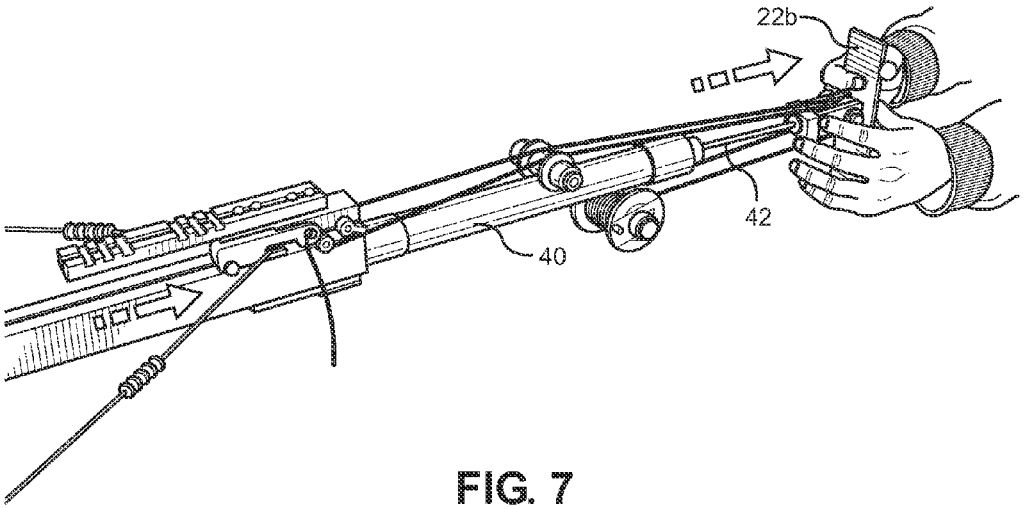
Figure 8:
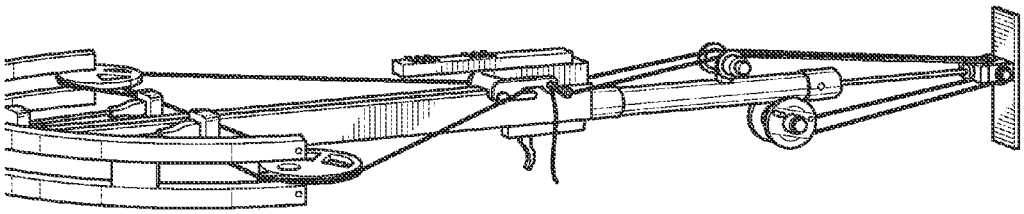
FIGS. 8-12 operation of the decocking system to decock the crossbow.
Figure 9:
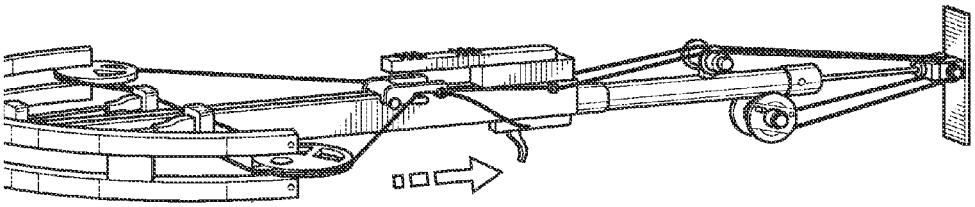
Figure 10:
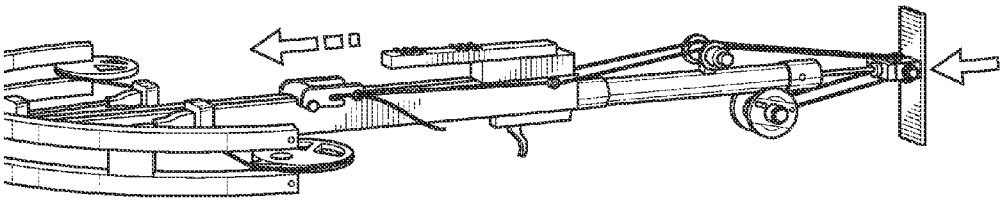
Figure 11:
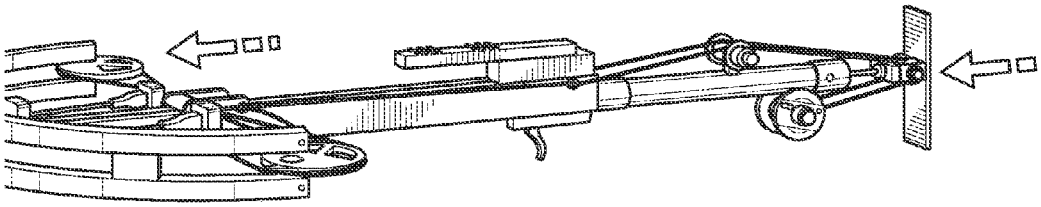
Figure 12:
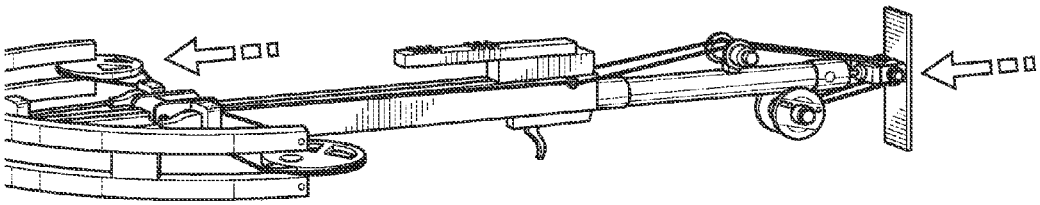

To utilize the decocking system 12 with a cocked crossbow, the bolt or arrow is removed and the system 12 is arranged to fill the cylinder 40 with fluid and the cradle 58 is located in the arrow groove 26 to position the hooks 56 to engage with the bowstring 16. This is depicted in the sequence of FIGS. 4-7. For example, as shown in FIGS. 4 and 5, the cradle 58 is moved from its inactive position out of the way of the groove 26 and positioned on the groove 26 with the hooks 56 located adjacent the bowstring 16. Next, as shown in FIGS. 6 and 7, the movable portion 22*b* of the butt stock 22 is pulled rearward which serves to extend the shaft 42 and thereby draw fluid (air) into the piston 40. This also serves to tension the cables 52 and pull the hooks 56 into engagement with the bowstring 16.

To decock the bow 10, as depicted in FIGS. 8-12, the trigger 16 is actuated to release the bowstring from the catch 24. The force supplied by the bow 14 via the bowstring 16 acts via the cables 52 to urge the piston and the shaft 42 to the retracted position in the cylinder 40. This movement of the piston forces fluid through the orifice thereof, moving the fluid from the front of the piston to behind the piston within the cylinder 40. The small orifice size regulates the fluid volume at a specific flow rate, permitting the piston to move through the cylinder 40 at a slow regulated pace, thus allowing the crossbow to decock under a controlled state. By doing so, the bowstring 16 which is attached to the bow, moves slowly from a tensioned position to a neutral uncocked position.

Accordingly, it will be appreciated that crossbows according to the disclosure include an integrated decocking system that enables a bowstring of the crossbow to be positioned from a cocked, ready-to-fire position, to an uncocked and at-rest position without firing a projectile or without dry firing the crossbow.

The foregoing description of preferred embodiments for this disclosure has been presented for purposes of illustration and description, it is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A crossbow having an integrated decocking device, the crossbow comprising:

a stock having a static portion and a movable portion, a bow having a bowstring, a bowstring catch a resistance system, including a fluid containing cylinder having a movable piston and located within the static portion of the stock, a shaft extending from the piston and having a terminal end, the piston being movable between a first position and a second position, and the cylinder including an orifice having a size and extending through the piston to enable fluid to travel from one side of the piston to the other and to control the movement of the piston to a desired rate; and a bowstring coupling system coupled to the resistance system and including a cable having a first portion releasably securable to the bowstring and a second portion of the cable interfacing with a location on the shaft of the resistance system;

wherein the device is operated to decock the crossbow when the crossbow is in a cocked state by releasably securing the cable to the bowstring, applying pressure to the piston by pulling on the shaft to extend the shaft, then actuating the catch to release the bowstring, wherein the released bowstring applies pressure to retract the shaft, which pressure is resisted by the resistance system, with the size of the orifice controlling the retraction of the shaft and thereby controlling travel of the bowstring and decocking of the crossbow.

2. The device of claim 1, wherein the bowstring coupling system comprises a pair of cables and a pair of pulleys mounted to the shaft of the resistance system for travel with the shaft.

3. The device of claim 1, wherein the fluid is a gas.

4. The device of claim 1, wherein the cylinder is a double-acting cylinder.

5. The device of claim 1, wherein the terminal portion of the shaft is connected to the movable portion of the stock, wherein a user may pull on the movable portion of the stock to apply manual pressure to the piston by pulling on the movable portion of the stock to extend the shaft.

6. A crossbow having an integrated decocking device, the crossbow comprising:

a bow having a bowstring, a bowstring catch a resistance system operatively associated with the crossbow and including a fluid containing cylinder having a movable piston, the piston being movable between a first position and a second position at a desired rate; and a bowstring coupling system coupled to the resistance system and including a cable having a first portion releasably securable to the bowstring and a second portion of the cable interfacing with the resistance system;

wherein the device is operated to decock the crossbow when the crossbow is in a cocked state by releasably securing the cable to the bowstring, applying pressure to the piston, then actuating the catch to release the bowstring, wherein the released bowstring applies pressure, which pressure is resisted by the resistance system to control travel of the bowstring and decocking of the crossbow.

7. The crossbow of claim 6, wherein the cylinder is located within a stock of the crossbow.

* * * * *